US006535180B1

(12) United States Patent
Gregorwich et al.

(10) Patent No.: US 6,535,180 B1
(45) Date of Patent: Mar. 18, 2003

(54) ANTENNA RECEIVING SYSTEM AND METHOD

(75) Inventors: Walter S. Gregorwich, Los Altos Hills, CA (US); Larry K. Lam, San Jose, CA (US); Robert B. Ward, Redwood City, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/038,817

(22) Filed: Jan. 8, 2002

(51) Int. Cl.[7] ..... H01Q 1/36
(52) U.S. Cl. ..... 343/895
(58) Field of Search ..... 343/713, 754, 343/757, 765, 895; 342/372; 455/89, 90; H01Q 1/24, 1/36

(56) References Cited

U.S. PATENT DOCUMENTS

| | | | | |
|---|---|---|---|---|
| 4,494,117 A | | 1/1985 | Coleman | 343/365 |
| 4,595,924 A | * | 6/1986 | Gehman | 340/554 |
| 4,641,146 A | * | 2/1987 | Gehman | 343/814 |
| 5,008,680 A | | 4/1991 | Willey et al. | 342/372 |
| 5,862,517 A | * | 1/1999 | Honey et al. | 702/85 |
| 5,923,305 A | * | 7/1999 | Sadler et al. | 343/895 |
| 6,013,580 A | * | 1/2000 | Yanahida | 438/710 |
| 6,094,178 A | * | 7/2000 | Sanford | 343/895 |

OTHER PUBLICATIONS

W. Gregorwich etal. "An Electronic Scanned Dual–Polarized Antenna for Tracking Multiple Targets Simutaneously" 1994 IEEE Aerospace Applications Conference.

W. Gregorwich etal. "Electronic Scanning Parabolic–Reflection Excited by a Cluster–Feed Array" 1995 IEEE Aerospace Applications Conference.

* cited by examiner

*Primary Examiner*—Tho Phan
(74) *Attorney, Agent, or Firm*—John Tarlano

(57) ABSTRACT

An antenna receiving system having an array of dual sense antenna elements for receiving both right hand and left hand circular polarized radiation from each of one or more targets, a right hand and a left hand polarized radiation attenuator and a right hand and a left hand polarized radiation phase shifter connected to each antenna element, a direction finding computer for controlling the attenuators and phase shifters connected to each antenna element and for processing outputs from selected pairs of phase shifters in order to find a direction to each of the one or more targets, and a beam forming computer for control the attenuators and phase shifters in order to select a cluster of antenna elements for each of one or more targets, each cluster for receiving data from a target.

3 Claims, 2 Drawing Sheets

ANTENNA RECEIVING SYSTEM AND METHOD

BACKGROUND OF THE INVENTION

In the prior art, an antenna receiving system had a direction finding computer that controlled attenuators and signal phase shifters.

The disclosed antenna receiving system has both a direction finding computer and a beam forming computer. Each of the direction finding computer and the beam forming computer control the same signal attenuators and signal phase shifters.

The presently disclosed antenna receiving system has a direction finding computer. The direction finding computer can determine a direction to one or more moving vehicles that transmit right handed and left handed circularly polarized radiation. A method used by the direction finding computer is disclosed.

The beam forming computer of the antenna receiving system then forms a beam in each found direction. The antenna receiving system receives data from each located moving vehicle over the beam formed on that moving vehicle.

The presently disclosed antenna receiving system includes a hemispherical array of dual sense helical antenna elements. Such a dual sense helical antenna element is disclosed in U.S. Pat. No. 4,494,117. The teachings of U.S. Pat. No. 4,494,117 are incorporated herein by reference. Such a dual sense helical antenna element is also referred to as a dual sense helicone, or simply a helicone.

The direction finding subsystem of the disclosed antenna receiving system nearly simultaneously electronically computes an angle of arrival of dual circularly polarized radiation from each of one or more moving vehicles. The direction finding subsystem then electronically determines a direction for formation of a central receiving antenna beam for receiving data from each of the one or more moving vehicles.

In the direction finding phase, right hand polarized radiation is received by each helicone element. The right hand polarized radiation comes from each moving vehicle. The amplitude and phase of an electrical voltage output produced due to right hand polarized radiation received by each dual sense helicone is adjusted by an attenuator and a phase shifter under control of the direction finding computer. The value of the amplitude and value of the phase of the adjusted electrical voltage output are then measured by the direction finding computer.

Also, left hand polarized radiation is received by each helicone. The left hand polarized radiation comes from each moving vehicle. The amplitude and phase of an electrical voltage output produced due to left hand polarized radiation received by each dual sense helicone is adjusted by an attenuator and a phase shifter under control of the direction finding computer. The value of the amplitude and the value of the phase of each adjusted electrical voltage output are then measured by the direction finding computer. From measured values of amplitude and phase, the direction finding computer locates a direction to each of one or more moving vehicles, nearly simultaneously.

The disclosed antenna receiving system also has a beam forming computer. The beam forming computer also adjusts and measures the amplitudes and phases of electrical voltage outputs produced due to right hand and left hand polarized radiation received by the dual sense helicones of the antenna receiving system. The beam forming computer uses the measurements of amplitude and phase to electronically determine a combination of four helicones, that taken together, forms a complete high gain antenna receiving beam. Information, that is data, can then be received in dual circularly polarized radiation received by the high gain antenna receiving beam.

Two electrical voltage outputs are produced within each helicone of the antenna array of the electronically steered hemispherical antenna array system due to reception by each helicone of the right and left hand circular polarized radiation coming from each moving vehicle. The beam forming computer forms and points a complete receiving antenna beam in the direction of dual circularly polarized radiation coming from each moving vehicle.

A direction for a central portion of the complete antenna receiving beam to each of the moving vehicles, is initially determined by the direction finding computer. The beam forming computer maximizes signal-to-noise ratio at output terminals of four selected helicones of the hemispherical antenna array, to receive information carrying radiation from each of the moving vehicles. Such information is referred to as data coming from the moving vehicle.

The following cited publications are incorporated herein by reference. The publications are:

1. Paper entitled "An Electronic Scanned Dual-Polarized Antenna for Tracking Multiple Targets Simultaneously" by W. Gregorwich et al., published as part of the 1994 IEEE Aerospace Applications Conference; and
2. Paper entitled "Electronic Scanning Parabolic-Reflection Excited by a Cluster-Feed Array" by W. Gregorwich et al., published as part of the 1995 IEEE Aerospace Applications Conference.

A first objective is to provide beamforming that ensures that the response of the antenna receiving system is smooth during electronically steered from one azimuth/elevation direction to another. To produce smoothness, the phase modulation of the beamformer output should be free from transient "phase jumps". The lack of smoothness is a problem suffered by a conventional switch network that are used for beamforming, resulting in loss of data(dropouts).

The second objective is to minimize the time needed by the antenna receiving system to steer its antenna beam from one direction to another.

The third objective is to minimize the amount of hardware, especially the number of phase shifters and antenna elements needed to implement the beamformer.

The forth objective is to enable the antenna receiving system to simultaneously track and receive data from a multiple number of moving vehicles by using the same beamforming network.

The fifth objective is to form antenna beams by using a multiple number of helicones, thus maximizing gain.

A prior art antenna receiving system might use PIN diode switches of a beamforming network to implement an antenna beam. Each additional antenna beam to be formed by the prior art antenna receiving system might use additional PIN diode switches of an additional beamforming network.

A prior art method of switching from one set of array elements to another set of array elements in a discrete fashion introduces transient phase jumps in the phase modulated signal at the output of a beamformer. Such jumps are not acceptable for most applications. Forming multiple beams is realized in a prior system by using multiple but independent beamforming networks. Such networks increase the weight, power consumption and complexity of the system.

The disclosed antenna receiving system allows a relatively small number of helicones, attenuators and phase shifters to form from two to four simultaneous receiving beams. This feature leads to smaller size and lighter weight.

The disclosed antenna system produces relatively low sidelobe levels below 15 degree elevation. This feature is important for multi-path mitigation.

The disclosed antenna system has a rapid and smooth beam steering response. This feature is important for the tracking of phase modulated telemetry signal without data dropout.

The disclosed antenna receiving system stores beamforming information in terms of the beam control byte values; thus, minimal time is required for beam steering during real time operation. The rapid formation of two independent beams, using the same beamforming network of attenuators and phase shifters, with no phase jump, is achieved. The implementation of the conjugate field matching solution is designed based on engineering judgment to give up a small amount in SNR to ensure the output of the beamforming subsystem produces a beam with a relatively low sidelobe level.

SUMMARY OF THE INVENTION

An antenna receiving system comprising an array of dual sense helical antenna elements for receiving right hand circular polarized radiation and left hand circular polarized radiation, each dual sense helical antenna element having a right hand circular polarized radiation signal output and having a left hand circular polarized radiation signal output, a set of right hand circular polarized attenuators and a set of left hand circular polarized attenuators, a right hand circular polarized attenuator connected to the right hand circular polarized radiation signal output of each dual sense helical antenna element and a left hand circular polarized attenuator connected to the left hand circular polarized radiation signal output of each dual sense helical antenna element, a set of right hand circular polarized phase shifters and a set of left hand circular polarized phase shifters, a right hand circular polarized phase shifter connected to a right hand circular polarized attenuator, and a left hand circular polarized phase shifter connected to a left hand circular polarized attenuator, a direction finding computer having a first output connected to an attenuation setting input of each of the set of right hand circular polarized attenuators, the direction finding computer having a second output connected to an attenuation setting input of each of the set of left hand circular polarized attenuators, the direction finding computer having a third output connected to a phase setting input of each of the set of right hand circular polarized phase shifters, the direction finding computer having a fourth output connected to a phase setting input of each of the set of left hand circular polarized phase shifters, a signal output of the set of right hand circular polarized phase shifters connected to the direction finding computer and a signal output of each of the set of left hand circular polarized phase shifters connected to the direction finding computer, and a beam forming computer having a first output connected to an attenuation setting input of each of the set of right hand circular polarized attenuators, the beam forming computer having a second output connected to an attenuation setting input of each of the set of left hand circular polarized attenuators, the beam forming computer having a third output connected to a phase setting input of each of the set of right hand circular polarized phase shifters, the beam forming computer having a fourth output connected to a phase setting input of each of the set of left hand circular polarized phase shifters, a signal output of the set of right hand circular polarized phase shifters connected to the beam forming computer and a signal output of each of the set of left hand circular polarized phase shifters connected to the beam forming computer.

DESCRIPTION OF THE PREFERRED EMBODIMENT

Figure 1A:
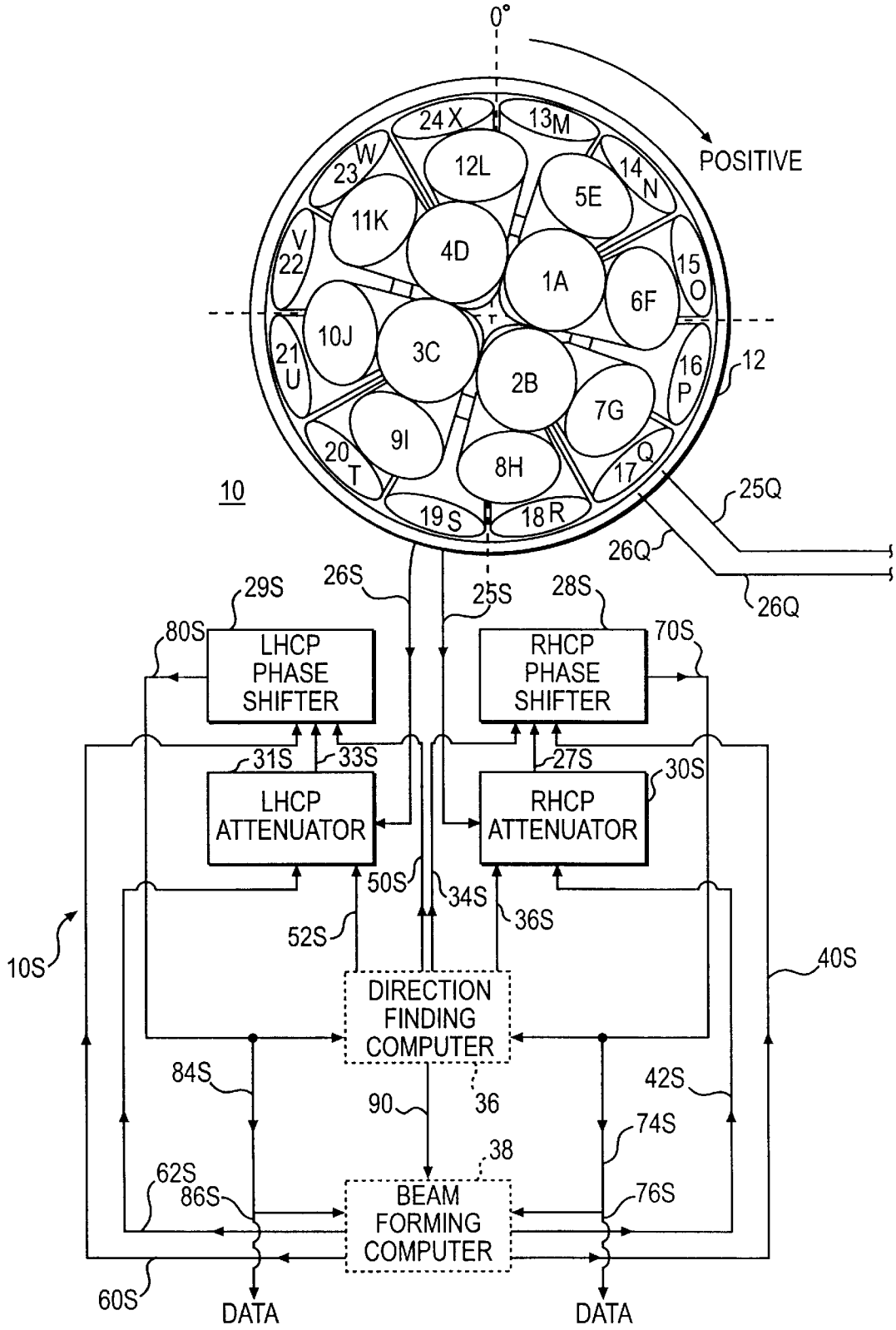
FIG. 1A is a circuit diagram of equipment connected to a helicone mounted on a dome-shaped half sphere, the equipment and helicone being part of an antenna receiving system.

FIG. 1A shows an array of 24 dual-sense helicones 1A to 24X. A line 25S and a line 26S are attached to the right hand circularly polarized radiation output and left hand circularly polarized radiation output, respectively, of dual-sense helicone 19S. A line 25Q and a line 26Q are attached to the right hand circularly polarized radiation output and left hand circularly polarized radiation output of dual-sense helicone 17Q respectively.

Figure 1B:
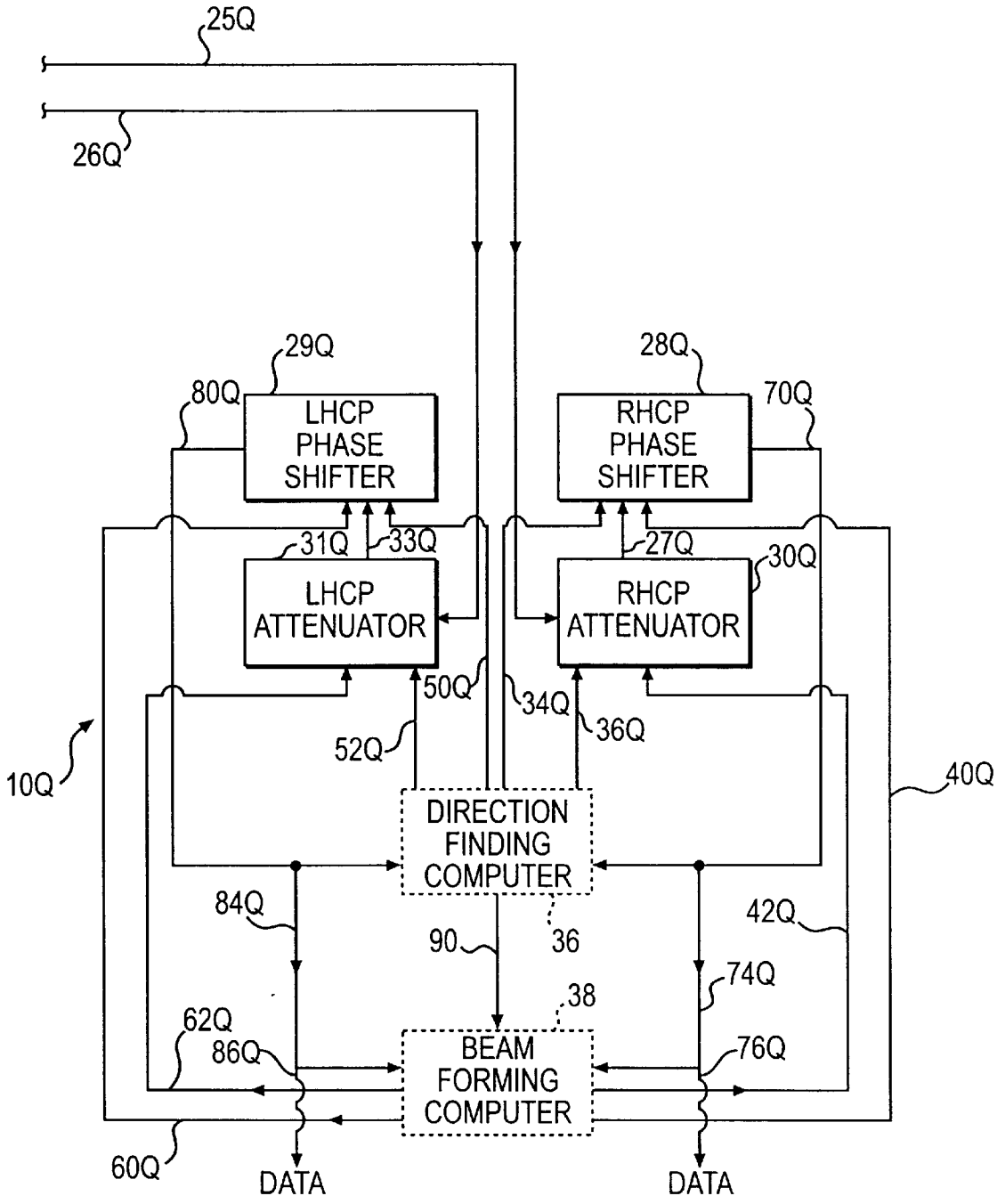
FIG. 1B is a circuit diagram of equipment connected to another helicone mounted on the dome-shaped half sphere of FIG. 1A, the equipment and helicone being part of an antenna receiving system.

FIGS. 1A and 1B show circuitry 10S and circuitry 10Q for operating the two dual sense helicones 19S and 17Q, of a twenty-four-helicone antenna 12 of antenna receiving system 10. The antenna receiving system 10 is referred to as an electrically steered hemispheric array (ESHA) antenna receiving system 10. The ESHA antenna receiving system 10 has an antenna 12 having twenty-four dual sense helicones, 1A to 24X, that are mounted onto a dome-shaped half sphere base. The dome-shaped antenna 12 is about 24 inches high and has a 36 inch diameter base.

The antenna receiving system 10 initially automatically finds and tracks a signal that is coming from an unknown time-varying azimuth/elevation angle of arrival (AOA).

Antenna receiving system 10 has twenty-four right hand circularly polarized (RHCP) phase shifters.

The twenty-four RHCP phase shifters are used to change the phase of twenty-four electrical voltage outputs produced due to receiption of RHCP radiation received by the twenty-four dual sense helicones. RHCP phase shifters 28S and 28Q are shown in FIGS. 1A and 1B.

Antenna receiving system 10 has 24 left hand circularly polarized (LHCP) phase shifters. The twenty-four LHCP phase shifters are used to change the phase of twenty-four electrical voltage outputs produced due to reception of LHCP radiation received by the twenty-four dual sense helicones. LHCP phase shifters 29S and 29Q are shown in FIGS. 1A and 1B.

Antenna receiving system 10 has twenty-four right hand circularly polarized (RHCP) attenuators. The twenty-four RHCP attenuators are used to change the amplitude of twenty-four electrical voltage outputs produced due to receiption of RHCP radiation received by the twenty-four dual sense helicones. RHCP attenuators 30S and 30Q are shown in FIGS. 1A and 1B.

Antenna receiving system 10 has twenty-four left hand circularly polarized (LHCP) attenuators. The twenty-four LHCP attenuators are used to change the amplitude of twenty-four electrical voltage outputs produced due to receiption of LHCP radiation received by the twenty-four dual sense helicones. LHCP attenuators 31S and 31Q are shown in FIGS. 1A and 1B.

Antenna receiving system 10 has a direction finding computer 36 and a beam forming computer 38. The ESHA antenna receiving system 10 thus has two major computational sections. One computational section is a direction-finding (DF) computer 36. The direction-finding computer 36 locates and tracks a signal from a moving vehicle. The other computational section is a beam forming (BF) computer 38. The beam forming computer 38 combines signals received by the dual sense helicones, so as to mathematically form a cluster of four helicones that together point a beam in the direction found by the DF computer 36, to maximize the signal-to-noise ratio at the output terminals of the ESHA antenna system 10. Data is then received from the moving vehicle.

Each of the dual-sense helicones 1A to 24X receives both left and right circularly polarized radiation signals. The helicones 1A to 24X have independent RHCP antenna output lines 25A to 25X, respectively and independent LHCP output lines 26A to 26X. Again, LHCP stands for left hand circularly polarized, and RHCP stands for right hand circularly polarized.

The same twenty-four dual sense helicones 1A to 24X which are used in the beam forming process are used in the direction finding process. Each dual sense helicone feeds an RF antenna module which, among other functions, sends a split-off portion of the received signal to the DF computer 36. The DF computer 36 uses these signals for phase interferometry direction finding. For a reference on phase interferometry direction finding, see Lipsky, S. E., "Microwave Passive Direction Finding", 1987, John Wiley and Sons Inc., New York. In the phase interferometry direction finding, phase difference between signals.from a pair of helicones is an input variable for a calculation of angle of attack, AOA. The angle of attack provides a direction to a signal source.

Phase direction finding is accurate but has inherit ambiguities which must be dealt with. The most closely spaced helicone pair of the antenna 12 has an unambiguous range of operation of about +/−20 degrees of AOA. Other pairs have even smaller unambiguous ranges.

The DF computer 36 of antenna system 10 measures and uses the amplitudes of a signal, as detected by the helicone elements, to avoid the above mentioned ambiguity hazard and to select the best helicone pairs for phase interferometry direction finding.

Use of the amplitudes is made difficult by the fact that (a) the amplitude patterns of the helicones, when assembled on the hemisphere, are much different than when a pattern is measured on an isolated helicone and (b) that the patterns on the hemisphere depend somewhat on polarization type and orientation of the incoming electromagnetic wave. Fortunately the phase-patterns of the helicones on the hemisphere are not nearly as distorted as the amplitude patterns.

In order to use amplitude measurements for direction finding purposes one must first take account of the amplitude or gain variations from one channel (helicone) to another due to manufacturing variations and other factors. This is done by measuring all 24 channel amplitudes at all AOAs in an anechoic chamber and finding from that data a set for 48 amplitude correction factors (24 for each polarization) which will thereafter be used to normalize amplitude measurements by using the attenuators.

Phase difference measurements similarly need to be "normalized" to account for rotational differences in the mounting of helicones, manufacturing variations, and other factors. This is also done in an anechoic chamber. An electronically variable phase shifter in the phase measurement circuit is adjusted while the ESHA antenna 12 is pointed at the AOA where the phase difference should be zero (at an AOA midway between the axes of the two helicones of a pair) and the phase shifter control voltage is noted that makes the phase difference read zero. This is done for each of the 44 helicone pairs that are used, and the results are put in a table. Thereafter when a phase measurement is to be made, the voltage from the table is first applied to the phase shifters for normalization.

Since the ESHA antenna system 10 has twenty-four helicones, there are 276 possible ways they can be paired to make phase difference measurements. Many of the possible pairs are of no interest since the helicones are far from each other or even on opposite sides of the hemisphere. There are 44 pairs, which are of use, however. So a primary task of the DF computer 36 is to select the two pairs to use for the DF measurement. (Two pairs must be used in order to establish the two dimensions, azimuth and elevation, of the angle-of-arrival.) Equally important is to ensure that selected pairs are operating in their unambiguous ranges or, if not, to properly adjust phase so that AOA calculation using phase is correct.

The twenty-four helicones are located on the hemisphere in three equal elevation rings. The top ring, at 70.5 degree elevation, has 4 helicones. The middle ring, at 45.5 degree elevation, has 8 helicones. The bottom ring, at 18.0 degree elevation, has 12 helicones.

FIG. 1A shows circuitry 10S to process signals from helicone 19S, helicone 19S being one of the twenty-four helicones of antenna receiving system 10. The circuitry 10S includes phase shifters 28S and 29S, and attenuators 30S and 31S. The circuitry 10S also includes direction finding computer 36 and beam forming computer 38.

A line 25S connects the RHCP portion of helicone 19S to to RHCP attenuator 30S. A line 27S connects RHCP attenuator to RHCP phase shifter 28S. Line 25S carries a RHCP helicone signal from helicone 19S. The helicone signal is a result of a right hand circular polarized radiation that helicone 19S receives from a moving vehicle. This helicone signal is attenuated by attenuator 30S as described below. This helicone signal is then phase shifted by phase shifter 28S as described below. The amount of attenuation and amount of phase shifting are first determined by the direction finding computer 36, when antenna system 10 is in a direction finding mode. Later, the amount of attenuation and the amount of phase shifting are determined by the beam-forming computer 38, when antenna system 10 is in a beam-forming mode.

In FIG. 1A, a line 26S connects the LHCP portion of helicone 19S to LHCP attenuator 31S. A line 33S connects LHCP attenuator 31S to LHCP phase shifter 29S. Line 26S carries a LHCP helicone signal from helicone 19S. The helicone signal is a result of a left-hand circular polarized radiation that helicone 19S receives from a moving vehicle. This helicone signal is attenuated by attenuator 31S as described below. This helicone signal is then phase shifted by phase shifter 29S as described below. The amount of attenuation and the amount of phase shifting are first determined by the direction finding computer 36, when antenna system 10 is in a direction finding mode. Later, the amount of attenuation and the amount of phase shifting are determined by the beam forming computer 38, when antenna system 10 is in a beam-forming mode.

FIG. 1A shows circuitry for setting the amount of phase shift in phase shifters 28S and 29S and the amount of attenuation in attenuators 30S and 31S by means of direction finding computer 36 and by means of beam forming computer 38.

A phase set line 34S extends from computer 36 to RHCP phase shifter 28S. An attenuation set line 36S extends from direction finding computer 36 to RHCP attenuator 30S. A phase set line 40S extends from beam forming computer 38 to RHCP phase shifter 28S. An attenuation set line 42S extends from beam forming computer 38 to RHCP attenuator 30S.

Similarly a phase set line 50S extends from direction finding computer 36 to LHCP phase shifter 29S. An attenuator set line 52S extends from direction finding computer 36 to LHCP attenuator 31S. A phase set line 60S extends from beam forming computer 38 to LHCP phase shifter 29S. An attenuator set line 62S extends from beam forming computer 38 to LHCP attenuator 31S.

A phase, amplitude and data line 70S extends from RHCP phase shifter 28S to direction finding computer 36. A line 74S is connected between line 70S and beam forming computer 38. A data line 76S is connected to line 74S.

Similarly, a phase, amplitude and data line 80S extends from LHCP phase shifter 29S to direction finding computer 36. A line 84S is connected between line 80S and beam forming computer 38. A data line 86S is connected to line 84S.

In FIG. 1A the direction finding computer 36 inputs commands to phase shifters 28S and 29S to set the phase shifting to be produced by phase shifters 28S and 29S, during a direction finding process, as described below.

Similarly the direction finding computer 36 sets attenuator values for attenuator 30S and attenuator 31S during a direction finding process, as described below.

Once the directions to moving vehicles have been determined by the direction finding computer 36, the direction information is sent to the beam forming computer 38 over line 90. Then the beam forming computer 38 inputs commands to phase shifters 28S and 29S to set the phase shifting to be produced by phase shifters 28S and 29S during a beam forming process as described below. Similarly the beam forming computer 38 sets attenuator values for attenuators 30S and 31S during a beam forming process as described below.

Once a receiving beam has been formed onto each of the moving vehicles, the tracking process has been carried out by the antenna system 10 and data is gathered from each vehicle by four helicones that, taken together, form a beam on each vehicle.

FIG. 1B shows circuitry 10Q to process signals from helicone 17Q, helicone 17Q being another one of the twenty-four helicones of antenna receiving system 10. The circuitry 10Q includes right hand circular polarized phase shifter 28Q and left-hand circular polarized phase shifter 29Q. The 10Q also includes a right hand circular polarized attenuator 30Q and a left hand circular polarized attenuator 31Q. The circuit lines shown in FIG. 1B are equivalent to the circuit lines shown in FIG. 1A. The equivalent circuit lines of FIGS. 1A and 1B have equivalent functions.

A line 25Q connects a RHCP portion of helicone 17Q to RHCP attenuator 30Q. A line 26Q connects a LHCP portion of helicone 17Q to LHCP attenuator 31Q.

Each of the other helicones 1A to 16P, 18R and 20T to 24X of antenna 12 is connected to a RHCP attenuator and to a LHCP attenuator in the same manner that helicone 19S is connected to attenuators 30S and 31S, as shown in FIG. 1A. These attenuators are connected to phase shifters in the same manner as shown in FIG. 1A.

The phase shifters and attenuators for each of the helicones 1A to 16P, 18R and 20T to 24X are connected to direction finding computer 36 and to beam forming computer 38 in the same manner that the phase shifters and attenuators are connected to the direction finding computer 36 and beam forming computer 38 as shown in FIGS. 1A and 1B.

In FIGS. 1A, the direction finding computer 36 finds the phase Fl of a RHCP radiation produced signal coming out of phase shifter 28S on line 70s, at a time T1. In FIG. 1B, the direction finding computer 36 also finds the phase F2 of a RHCP radiation produced signal coming out of phase shifter 28Q on line 70Q at that same time T1. A positive difference F3 in phase, where F2–F1=F3, indicates that the moving target is moving toward helicone 17Q at a faster rate than it is moving toward helicone 19S.

Similarly the direction finding computer 36 finds the strength S1 of a RHCP radiation produced signal coming out of phase shifter 28S on line 70S, at a given time T2. The direction finding computer 36 also finds the strength S2 of a RHCP radiation produced signal coming out of phase shifter 28Q on line 70Q at that same time T2. A positive difference S3 in strength, where S3=S2–S1, indicates that the moving vehicle is closer to helicone 17Q than it is to helicone 19S. The above calculations would be repeated for left hand circular polarized radiation reception by helicones 19S and 17Q.

From information from pairs of helicones, a direction finding computer 36 can calculate the direction from antenna receiving system 10 to the moving target. The direction finding process is further described below.

Once the direction found by the direction finding computer 36 is determined, the beam forming computer 38 finds phases of signals coming out of the RHCP and LHCP phase shifters associated with all of the twenty four helicones. The beam forming computer 38 also finds the amplitude of the signals. The beam forming computer 38 chooses four helicones to receive a signal from each moving vehicle, as described below. The four helicones, taken together, form a receiving beam.

Because operation of the ESHA antenna receiving system 10 is desired down to low (even negative) elevation angles, there is a basic difference in the direction finding and beam forming methods at low elevations compared to the methods at high elevations. This is reflected in the detailed DF computer operation described below.

During tracking operation, the ESHA antenna computer 10 is making direction finding measurements. At the beginning of each direction finding interval, each of the pairs of helicones is monitored. A measurement of the amplitude of the detected signal from each helicone of each of the 44 pairs is made. As well, a measurement of the phase difference of the two detected signals from each pair of the 44 pairs of helicons is made. These amplitude and phase difference measurements are performed for each of the two polarizations.

The amplitudes are then normalized with respect to values that had been obtained from an anechoic chamber 2-degree by 2-degree amplified calibration run. For each helicone of each pair, the normalized amplitudes, for each of the two polarizations, are summed. For each pair, the normalized amplitudes are summed and their ratios are calculated. (Ratio=amplitude of helicone element A signal/amplitude of helicone B signal where helicone element A is at higher elevation than B or if at the same elevation is at a more positive azimuth than B.) Then the following logic steps are performed which lead to the selection of a cluster (two pairs of helicons) for use in calculating AOA by phase direction finding which with practical certainty is working in its zeroth ambiguity zone.

1. The 6 pairs having the largest summed amplitudes are found and the largest three are ordered.
2. The same 6 pairs are ordered by their ratios; closest to 1.000, next closest, $-6^{th}$ closest. In order to simplify the ordering process the ratios are all made less than 1.000 for the comparisons by inverting those which initially are above 1.000. For later steps the ratios are used in their original state.
3. Perform the logic steps in the following logic tree to separate the case into one or two categories: A—the target elevation angle is higher than about 35 degrees or B—the target elevation is lower than about 35 degrees. Then apply either procedure A or B to select a cluster and calculate angle-of-arrival.
4. If case 4 is found by the tree: Find out which pair is the #1 amplitude and enter Table in procedure B.2 to find which second pair to use. Depending on the ratio of the second pair use procedure A if ratio>1 or use procedure B if ratio<1.

Procedure A:

1. Label each of the 6 candidate pairs unusable if it falls in the following categories and don't use/select it.
   a. −180 deg<phase<−120 deg AND Ratio>1.000
   b. 120 deg<phase<180 deg AND Ratio<1.000
   c. Ratio<0.05
   d. Ratio>20.0
2. Select the highest ranking ratio to use a Pair 1. Look at the next highest ranking ratio to see if it is in the cluster list with Pair 1. If so, then Pair 1 and the next pair are the selected cluster of helicones. If not, look at the next highest, etc.
3. If no cluster is found with the highest ranking ratio, select the $2^{nd}$ highest ranking ratio for Pair 1. Try to find a cluster using the remaining pairs as before.
4. If no cluster is found don't report data and then take a new data set.

Procedure B:

1. Select the pair from among the selected lower ring pairs that has the ratio nearest 1.000. Apply tests A.1.a and A.1.b. If a test is failed (test result TRUE), add 360 deg to the phase if A.1.a is TRUE, or subtract 360 deg from the phase if A.1.b is TRUE.
2. Use the following table to select a second pair to go with the first pair. (The selected second pair might not have been among the 6 pairs selected in the summed amplitude selection step.)

| (First Pair) | (Amplitude ratio of first pair) | (Second Pair) |
|---|---|---|
| 13/14 | Dont care | 5/14 |
| 14/15 | <1.000 | 5/14 |
| 14/15 | >1.000 | 6/15 |
| 15/16 | Dont care | 6/15 |
| 16/17 | Dont care | 7/17 |
| 17/18 | <1.000 | 7/17 |
| 17/18 | >1.000 | 8/18 |
| 18/19 | Dont care | 8/18 |
| 19/20 | Dont care | 9/20 |
| 20/21 | <1.000 | 9/20 |
| 20/21 | >1.000 | 10/21 |
| 21/22 | Dont care | 10/21 |
| 22/23 | Dont care | 11/23 |

-continued

| (First Pair) | (Amplitude ratio of first pair) | (Second Pair) |
|---|---|---|
| 23/24 | <1.000 | 11/23 |
| 23/24 | >1.000 | 12/24 |
| 24/13 | Dont care | 12/24 |

3.
   a. If the ratio of pair 2 is <0.02, set the value of the pair 2 phase to −330 degrees.
   b. If the phase of pair 2 is 0 deg<phase<180 deg AND the ratio is 0.02<ratio<0.400, subtract 360 deg from the phase.
   c. If the phase of pair 2 is −180<phase<0 deg AND the ratio is 0.02<ratio<0.400, use phase as is.
   d. If the ratio is 0.40<ratio<2.50, use phase as is.
   e. If the phase of pair 2 is −180<phase<0 deg AND ratio>2.500, add 360 deg to the phase.
   f. If the phase of pair 2 is 0<phase<180 AND the ratio>2.50, use phase as is.
4. Use the cluster of 2 pairs of helicons with phases modified as above to calculate AOA.

The beam forming computer 38 of electronically steered hemispheric array (ESHA) antenna receiving system 10 operates in frequency bans of 2200–2300 MHz to electronically form an antenna receiver beam of about 30 degree beamwidth with a gain of about 15 dB over roughly a hemisphere.

A method of electronically beam steering using antenna response of the antenna receiving system 10 to track the telemetry from multiple sources as described below. Antenna system 10 produces sets of circularly polarized RF outputs designated by LHCP, left hand circular polarization, and RHCP, right hand circular polarization. The beamforming network for the 24 LHCP outputs from the 24 helicones is comprised of a network of 24 attenuators and 24 phase shifters. There is a similar but independently controlled network of 24 attenuators and 24 phase shifters for the 24 RHCP outputs from the same 24 helicones.

The following description assumes that 24 LHCP outputs are being processed for beam forming. However, 24 RHCP outputs are also processed for beam forming. The theoretical beamforming problem is stated as follows:

An array of 24 output signals is given, denoted by Xn. An output signal from each of the 24 helicones is expressed as Xn. Xn includes an input signal Sn to each of the 24 helicones. Xn=Sn+ko, with n=1,2,3, etc.to 24. Sn represents the incident signal received by the nth helicone. ko represents white noise out of each helicone.

The output of the beamformer, YLHCP, is a linear combination of these signals. YLHCP=[Sum BnXnfor n=1 to 24]. The coefficients, Bn, are the beamforming coefficients designed to maximize the signal to noise ratio, SNR.

$$SNR=[\text{Sum } BnXn \text{ for } n=1 \text{ to } 24][\text{Sum } BnXn \text{ for } n=1 \text{ to } 24]^*\backslash[\text{Sum } Bnko \text{ for } n=1 \text{ to } 24][\text{Sum } Bnko \text{ for } n=1 \text{ to } 24]^*$$

$$SNR=[\text{Sum } BnXn \text{ for } n=1 \text{ to } 24][\text{Sum } BnXn \text{ for } n=1 \text{ to } 24]^*\backslash[\text{Sum } BnBn^* \text{ for } n=1 \text{ to } 24][Ko]$$

where Ko=[Sum koko* for n=1 to 24] and Ko denotes the total noise power.

By taking the derivative of the expression for SNR with respect to Bn, it can be shown that SNR is maximized when Bn*=(Sn)(G), where G is a constant, for n=1 to 24.

This is a conjugate field matching solution [see reference 1]. The conjugates of the beamforming coefficients are proportional to the corresponding signal amplitudes and phases.

It is not feasible in the ESHA case to compute these coefficients based on theoretical parameters, because they depend on variations in the antenna response that are not known before the antenna is manufactured. These variations are due to small variations in the manufacturing process. A method of estimating the coefficients based on experimental measurements has been devised as follows:

The coefficients and the summation of signals are implemented by the network of attenuators and phase shifters. The attenuations and phase delays are programmed based on the values of beam control bytes that varies from 0 to 255, 0 being minimum attentuation or phase delay, 255 being maximum attentuation or phase delay. To minimize the needed time to determine the beam control bytes during a real time tracking operation, the measurement is done in terms of the values of the control bytes, so that stored values of the control bytes are retrieved from a lookup table to perform beamforming in real time.

For a given beamforming direction, as denoted by azimuth and elevation, (az, el), a matrix of parameters, denoted by B, is estimated by measuring the outputs of ESHA with an external test source located at the (az, el) direction relative to ESHA.

$$B = \begin{matrix} b_{11} & b_{12} & b_{13} \\ b_{21} & b_{22} & b_{23} \\ b_{31} & b_{32} & b_{33} \\ b_{41} & b_{42} & b_{43} \end{matrix} = \begin{matrix} (\text{ant\#, atten_value, phase_value})_1 \\ (\text{ant\#, atten value phase value})_2 \\ (\text{ant\#, atten_value, phase_value})_3 \\ (\text{ant\#, atten_value, phase_value})_4 \end{matrix} \quad B1$$

The first column specified four helicones, the output of which are to be combined to form a beam. It is necessary to use only a few helicones to form a beam to obtain close to the maximum SNR, and we have chosen four to save memory space.

The second column specifies the binary values needed to control the associated attenuators. The value for b12 is equal to zero, which means minimum attenuation, while b22 to b42 are equal to the binary values to provide the attenuations needed to approximate the CFM (Conjugate Field Machine) solution. These values are determined by measuring the individual signal amplitudes above the noise level before any attenuation is applied.

The third column specified the binary values needed to control the associated phase shifters. Norminally b13 is equal to 255, which means maximum phase delay. b23 to b43 are equal to the binary values needed to provide the phase delays to approximate the CFM solution. The procedure is as follows: By setting b13 to maximum phase delay, the value to b23 is varied until the combined output of helicone b11 and b21 is maximized. Similarly, by setting b13 to maximum phase delay, the value of b33 is varied until the combined output of helicone b11 and b31 is maximized, and the same for b43. Since the helicone antennas located at the top ring of the antenna 12 are oriented at 90 degree from each other, it is possible that a setting of b13 to maximum phase delay causes the other phase shifters to run out of range before they can be adjusted to produce the maxima. In that case, b23 is set to maximum phase delay and the.above procedure is repeated.

A matrix of parameters are estimated based on the above procedure for every five degrees in elevation from 15 to 90 degrees, and every five degrees in azimuth from 0 to 355 degrees. The resultant is a beamforming table. After the entire beamforming table is produced, an inspection procedure is performed to eliminate erroneous entries or discontinuities in the beamforming table.

The direction finding system of ESHA antenna system 10 produces an estimate of the azimuth and elevation, az/el, that is the location of the source. The estimates are routed off to the nearest AZ/EL coordinate on a five degree grid. This is the index into the beamforming table to extract the B control values for the LHCP and RHCP networks.

A 10 rows by 96 columns beam control table is constructed for this purpose to ensure that the output of the beamformer produces a smooth phase varying telemetry signal. Each row of the table contains all the control bytes needed for each of the attenuators and phase shifters in the RHCP and LHCP networks. They are denoted by the following:

$$(\text{atten_value}_1\ \text{phase_value}_1\ \text{atten_value}_2\ \text{phase_value}_2 \ldots \text{atten_value}_{24}\ \text{phase_value}_{24})\text{RHCP}$$

$$(\text{atten_value}_1\ \text{phase_value}_1\ \text{atten_value}_2\ \text{phase_value}_2 \ldots \text{atten_value}_{24}\ \text{phase_value}_{24})\text{LHCP}$$

Each time ESHA antenna system 10 determines that a signal source is found, and the estimated az/el are valid, the $9^{th}$ row of the beam control table is initialized with values of 255.

The $10^{th}$ is not used in this case. Then the values of b12 & b13 are copied into the slot for antenna specified by b11,
the values of b22 & b23 are copied into the slot for antenna specified by b12,
the values of b32 & b33 are copied into the slot for antenna specified by b13, and
the values of b42 & b42 are copied into the slot for antenna specified by b14.

Row 1–8 is used for producing an averaged beam control coefficient set as follows: There is a flag that points to the most recently filled row in rows 1–8. The data in the $9^{th}$ row is into a designated "new" row in rows 1–8. The new row label is recycled circularly within rows 1–8.

The values in the beam control table are averaged by column from rows 1–8. The averaged values are used to program the appropriate attenuation and phase shifter controls.

A beam control table is constructed based on a 10 by 96 table. The $9^{th}$ row is to store the values created by the most recent B coefficients for source #1, and the $10^{th}$ row is to store the values created by the most recent B coefficients for source #2. The entire 10 by 96 table is initialized to values of 255.

When the ESHA antenna system 10 finds the first telemetry source, #1:

a. It obtains B.

b. The $9^{th}$ row is initialized to values of 255, and the values of B are inserted into the $9^{th}$ row as described in step 2 of the section on tracking a single telemetry signal source c. The values of the $9^{th}$ row are copied into the designated "new" row.

d. Any value in the $10^{th}$ that is greater than the corresponding value in the $9^{th}$ row is copied into the designated "new" row.

When ESHA finds the second telemetry source, #2:

a. It obtains B.

b. (similar to b. of the above) The $10^{th}$ row is initialized to values of 255, and the values of B are inserted into the $10^{th}$ row as described in step 2 of the section on tracking a single telemetry signal source.

c. (c. and d. are similar to the c. and d. of the above).

d. same as c.

The values in rows 1–8 of the beam control table are averaged in column only and sent out to program the appropriate attenuators and phase shifters.

Two beams are formed for each target. The two beams consist of a first beam production for reception of LHCP radiation and a second beam produced for reception of RHCP radiation.

While the present invention has been disclosed in connection with the preferred embodiment thereof, it should be understood that there may be other embodiments which fall within the spirit and scope of the invention as defined by the following claims.

What is claimed is:

1. An antenna receiving system, comprising:

(a) an array of dual sense helical antenna elements for receiving right hand circular polarized radiation and left hand circular polarized radiation, each dual sense helical antenna element having a right hand circular polarized radiation signal output and having a left hand circular polarized radiation signal output;

(b) a set of right hand circular polarized attenuators and a set of left hand circular polarized attenuators, a right hand circular polarized attenuator connected to the right hand circular polarized radiation signal output of each dual sense helical antenna element and a left hand circular polarized attenuator connected to the left hand circular polarized radiation signal output of each dual sense helical antenna element;

(c) a set of right hand circular polarized phase shifters and a set of left hand circular polarized phase shifters, a right hand circular polarized phase shifter connected to a right hand circular polarized attenuator, and a left hand circular polarized phase shifter connected to a left hand circular polarized attenuator;

(d) a direction finding computer having a first output connected to an attenuation setting input of each of the set of right hand circular polarized attenuators, the direction finding computer having a second output connected to an attenuation setting input of each of the set of left hand circular polarized attenuators, the direction finding computer having a third output connected to a phase setting input of each of the set of right hand circular polarized phase shifters, the direction finding computer having a fourth output connected to a phase setting input of each of the set of left hand circular polarized phase shifters, a signal output of the set of right hand circular polarized phase shifters connected to the direction finding computer and a signal output of each of the set of left hand circular polarized phase shifters connected to the direction finding computer; and (e) a beam forming computer having a first output connected to an attenuation setting input of each of the set of right hand circular polarized attenuators, the beam forming computer having a second output connected to an attenuation setting input of each of the set of left hand circular polarized attenuators, the beam forming computer having a third output connected to a phase setting input of each of the set of right hand circular polarized phase shifters, the beam forming computer having a fourth output connected to a phase setting input of each of the set of left hand circular polarized phase shifters, a signal output of the set of right hand circular polarized phase shifters connected to the beam forming computer and a signal output of each of the set of left hand circular polarized phase shifters connected to the beam forming computer.

2. An antenna receiving system, comprising:

(a) an array of dual sense helical antenna elements for receiving right hand circular polarized radiation and left hand circular polarized radiation, each dual sense helical antenna element having a right hand circular polarized radiation signal output and having a left hand circular polarized radiation signal output;

(b) a set of right hand circular polarized attenuators and a set of left hand circular polarized attenuators, a right hand circular polarized attenuator connected to a right hand circular polarized radiation signal output of each dual sense helical antenna element and a left hand circular polarize attenuator connected to a left hand circular polarized radiation signal output of each dual sense helical antenna element;

(c) a set of right hand circular polarized phase shifters and a set of left hand circular polarized phase shifters, a right hand circular polarized phase shifter connected to each right hand circular polarized attenuator, and a left hand circular polarized phase shifter connected to each left hand circular polarized attenuator;

(d) a direction finding computer having a first output connected to an attenuation setting input of each of the set of right hand circular polarized attenuators, the direction finding computer having a second output connected to an attenuation setting input of each of the set of left hand circular polarized attenuators, the direction finding computer having a third output connected to a phase setting input of each of the set of right hand circular polarized phase shifters, the direction finding computer having a fourth output connected to a phase setting input of each of the set of left hand circular polarized phase shifters, a signal output of the set of right hand circular polarized phase shifters connected to the direction finding computer and a signal output of each of the set of left hand circular polarized phase shifters connected to the direction finding computer, the direction finding computer finding a direction to each of a multiple number of moving vehicles that emit right hand circular polarized radiation and left hand circular polarized radiation to the array of dual-sense helicones, the direction finding computer comprising:

(a') means for detecting both right hand circular polarized radiation and left hand circular polarized radiation from the multiple number of moving vehicles, simultaneously, by means of the array, the array comprising twenty-four dual sense helicones that define a hemispherical surface;

(b') means for forming pairings of the dual-sense helical antenna elements;

(c') means for determining amplitude information and phase difference information of both right hand circular polarized radiation and left hand circular polarized radiation for each of the pairings; and (d') means for choosing a pairing that points in a direction to each moving vehicle in a field of view of the array of dual sense helical antenna elements; and (e) a beam forming finding computer having a first output connected to an attenuation setting input of each of the set of right hand circular polarized attenuators, the beam forming computer having a second output connected to an attenuation setting input of each of the set of left hand circular polarized attenuators, the beam forming computer having a third output connected to a phase setting input of each of the set of right hand circular polarized phase shifters, the beam forming computer having a fourth output connected to a phase setting input of each of the set of left hand circular polarized phase shifters, a signal output of the set of right hand circular polarized phase shifters connected to the beam forming computer and a signal output of each of the set of left hand circular polarized phase shifters connected to the beam forming computer, the beam forming computer comprising means for forming clusters of dual sense helical antenna elements, each cluster pointing in a found direction to a moving vehicle, each cluster forming a receiving beam to receive data from one of the multiple number of moving vehicles.

3. A method for finding a direction to each of a multiple number of moving vehicles, the method used by a direction finding computer of an antenna receiving system, comprising:

(a) detecting both right hand circular polarized radiation and left hand circular polarized radiation from the multiple number of moving vehicles, simultaneously, by means of an array, the array comprising twenty-four dual sense helicones that define a hemispherical surface;

(b) forming pairings of the dual-sense helical antenna elements;

(c) determining amplitude information and phase difference information of both right hand circular polarized radiation and left hand circular polarized radiation for each of the pairings; and (d) choosing a pairing that points in a direction to each moving vehicle in a field of view of the array of dual sense helical antenna elements.

* * * * *